US005435738A

United States Patent [19]

Isohata

[11] Patent Number: 5,435,738

[45] Date of Patent: Jul. 25, 1995

[54] LEVER-TYPE CONNECTOR

[75] Inventor: Shigeru Isohata, Tokyo, Japan

[73] Assignee: The Whitaker Corporation, Wilmington, Del.

[21] Appl. No.: 308,009

[22] Filed: Sep. 16, 1994

[30] Foreign Application Priority Data

Oct. 18, 1993 [JP] Japan ..... 5-283956

[51] Int. Cl.[6] ..... H01R 13/62

[52] U.S. Cl. ..... 439/157; 439/695; 439/271

[58] Field of Search ..... 439/153-157, 439/160, 372, 271, 695, 701

[56] References Cited

U.S. PATENT DOCUMENTS

| | | | |
|---|---|---|---|
| 4,586,771 | 5/1986 | Kraemer et al. . | |
| 4,621,883 | 11/1986 | Noguchi . | |
| 4,682,847 | 7/1987 | Moore et al. | 350/96.20 |
| 5,083,933 | 1/1992 | Colleran et al. | 439/357 |
| 5,183,408 | 2/1993 | Hatagishi | 439/147 |
| 5,197,898 | 3/1993 | Nagamine | 439/271 |
| 5,197,899 | 3/1993 | Akeda | 439/271 |

FOREIGN PATENT DOCUMENTS

| | | | |
|---|---|---|---|
| 4174983 | 8/1990 | Japan | 439/372 |
| 5-121121 | 5/1993 | Japan . | |

*Primary Examiner*—Larry I. Schwartz
*Assistant Examiner*—Jill DeMello
*Attorney, Agent, or Firm*—Mary K. Van Atten; Adrian J. LaRue

[57] ABSTRACT

The plug housing (40) is placed inside the cover housing (10), and they are joined together by means of the lever (2). Holes (8) of the lever (2) are placed over mounting projections (18), and the lugs (5) of the lever (2) are engaged with the lug engaging members (50) of the plug housing (40) through the opening (16). The lugs (86) of the cap housing (80) are latched in the slots (22) of the cover housing (10), thus joining these housings together. By operating the lever (2), the plug housing (40) is moved inside the cap housing (80) making electric connection with the contacts of the cap housing (80).

7 Claims, 3 Drawing Sheets

LEVER-TYPE CONNECTOR

FIELD OF THE INVENTION

This invention relates to electrical connectors, especially to the lever-type connectors in which a lever is used to reduce the force required for the connection.

BACKGROUND OF THE INVENTION

Since so-called multi-contact connectors require a considerable force for their connection, in many cases their manual connection becomes a difficult task. Therefore, lever-type connectors were proposed, in which a pair of connectors can be connected using relatively low force.

As an example of such connectors, a lever-type connector 100, Japanese Patent Application No. 5 (1993)-121121 is shown in FIG. 3. This lever-type connector 100 comprises a plug housing 102, a cap housing 120 and a lever 140 supported by a spring 130. In the side wall 121 of the cap housing 120, there is an opening 122. The lever 140 is designed in such a manner that it can rotate relative to lugs 124 formed in the side walls 121 of the cap housing 120. A flat section 142 of the lever 140 has a notch 146 and a slot 148 connected to it which is inclined relative to the opening 122. On the other hand, on the side walls 103 of the plug housing 102, protrusions 104 are made. When the plug housing 102 is inserted in the cap housing 120, these protrusions 104 slide into the slot 148 of the lever 140, and eventually become engaged with the notch 146. After that, the lever 140 is rotated in the direction of arrow A, resulting in forcing the plug housing 102 into the cap housing 120.

However, in such conventional lever-type connectors, the lever 140 is supported by the spring 130, and in some cases this spring can be distorted out of shape by an external force, resulting in a poor engagement of the protrusions 104 into the slot 148. This problem becomes especially serious in cases when the connectors are used in locations where the worker cannot see them directly.

In addition, in cases when the plug housing and the cover housing enveloping it are molded as a single unit, the sealing elements located on the plug housing can not be molded in two colors. It is also difficult to implement a so-called double-lock device providing a secondary securing of the contacts when the insertion is carried out in the direction perpendicular to the direction of contacts. In this case, it is also impossible to effectively increase the contact-retaining force.

SUMMARY OF THE INVENTION

The lever-type connector according to this invention is characterized by the fact that it comprises a plug sub-assembly having a cover housing with an opening in its front surface and a plug housing comprising terminals which are retained in the above mentioned opening by means of a lever, and of a cap housing having contacts to be connected with the above mentioned terminals receiving the above mentioned plug housing latched in the above mentioned opening of the cover housing which is driven in by means of said lever.

BRIEF DESCRIPTION OF THE DRAWINGS

An embodiment of the invention will now be described by way of example with reference to the accompanying drawings, in which.

DETAILED DESCRIPTION OF THE INVENTION

Figure 1:
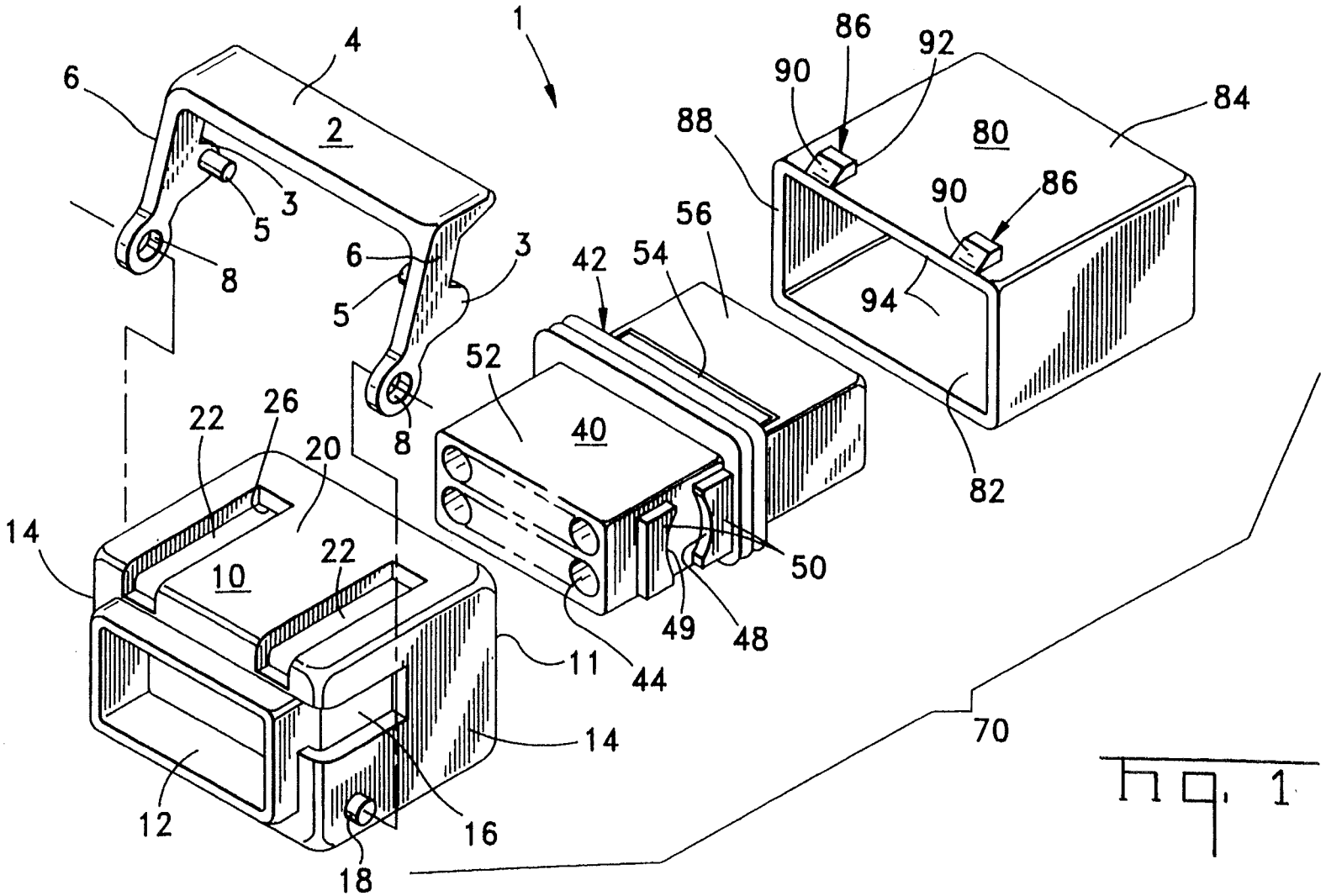
FIG. 1 is an exploded oblique view of the lever-type connector according to this invention.

The lever-type connector 1 has a cover housing 10 of nearly rectangular shape, a lever 2, a plug housing 40 and a cap housing 80. In the front and back surfaces of the cover housing 10, there are rectangular openings 11 and 12, respectively. On both side walls 14, oblong openings 16 are made extending from the back to the front. In the lower portion of the side walls 14, mounting projections 18 are made. In the upper wall 20, two slots 22 at a certain distance from each other are made which extend from the back to the front. Here, we will call the side facing the cap housing 80 the front side, and the back side will be at the opposite end.

The plug housing 40 is a rectangular part elongated in the direction of insertion and removal having a sealing element 42 located in approximately middle of the plug housing 40 made of a rubber, a silicone resin or other similar material of a different color. The sealing element remains in place during insertion and removal of the plug housing. Cavities 44 are for the terminals (not shown in the drawing). The cavities 44 are arrayed in two rows. At both side surfaces of the plug housing 40, there are spaced lug engaging members 50 having arc-shaped surfaces 48, 49 facing each other. The engaging members 50 are made in the locations matching the openings 16 of the cover housing 10.

When the back section of 52 of the plug housing 40 is inserted in the openings 11 and 12 of the plug housing 10, the arc-shaped surfaces 48 of the plug housing 40 enter the opening 16 of the cover housing 10. When the cover housing 10 and the plug housing 40 are in this position, a lever 2 is mounted in such a manner as to join both housings 10 and 40. The lever 2 has a nearly flat operating section 4 and arms 6 extending from both ends of the operating section 4. At the ends of the arms 6, holes 8 are provided to accommodate mounting projections 18 of the cover housing 10. Tongues 3 extending forward are made between the holes 8 and the operating section 4. Cylindrical lugs 5 extending inward are made on the tongues 3. When the holes 8 located at the ends of the arms 6 of the lever 2 are placed over the mounting projections 18 of the cover housing 10, lugs 5 of the tongues 3 enter engaging members 50 of the plug housing 40 through the opening 16. This completes the assembly of the plug sub-assembly 70. If the lever 2 is rotated in this position, lugs 5, using mounting projections 18 as a fulcrum, will move inside the opening 16 and push either the arc-shaped surface 48 or the arc-shaped surface 49. Because of this, the plug housing 40 will move in the direction of either insertion into or pulling out of the cover housing 10. A section identified in the drawing as 54 is known in the art as a so-called double lock device providing addition retaining power for the contacts. Since this double lock device 54 operates perpendicular to the cavities 44 of the plug housing 40, it provides reliable connection of the contacts.

The cap housing 80 has a nearly rectangular opening 82 at its matching surface. The dimensions of the opening 82 are determined by the considerations that the front end 56 of the plug housing 40 would fit inside in such a manner that the outer edges of the sealing element were in contact with the inner walls of cap housing 80. On the upper surface 84 of the cap housing 80, lugs 86 are made which fit inside the slots 22 of the cover housing 10. Spacing and location of the lugs 86 correspond to those of the slots 22. The lugs 86 have inclined surfaces 90 facing in the direction of the matching surface 88. When the cap housing 80 and the plug housing 40 are joined together, the front edge of the lower surface 26 of the upper wall 20 of the cover housing 10 comes against the inclined surfaces 90, and the edges 26 of the slots 22 pass beyond the back edges 92 of the lugs 86. As the result of the elastic action of the upper wall 20, the edges 26 become engaged with the back edges 92, thus securing the attachment of the cover housing 10 and the cap housing 80. At this time, the back end 52 of the plug housing 40 protrudes from the opening 12 of the cover housing 10, and the operating section 4 is turned backward. The plug housing 40 is retained in the cap housing 80, but the contacts of the housings 40 and 80 are not yet connected together.

Figure 2A:
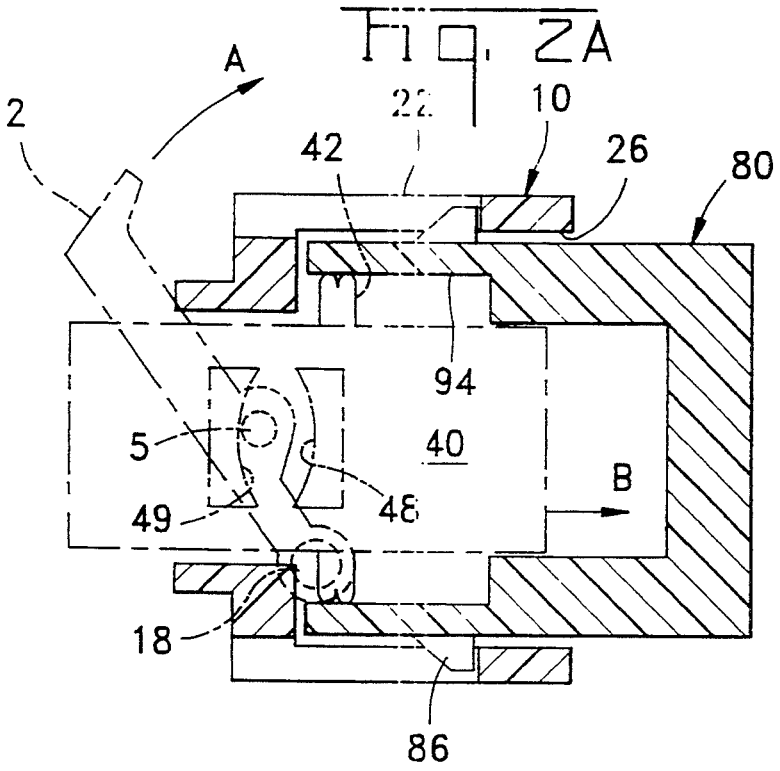
FIG. 2(A) is a longitudinal cross section of the lever-type connector according to this invention in an engaged position.
Figure 2B:
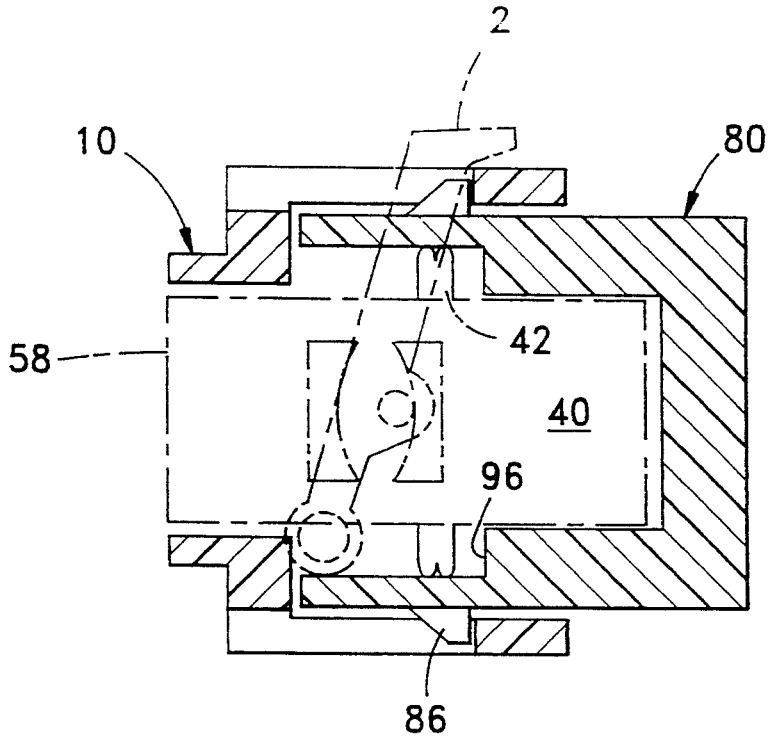
FIG. 2(B) is a longitudinal cross section of the lever-type connector according to this invention after the connection is completed.
Figure 3:
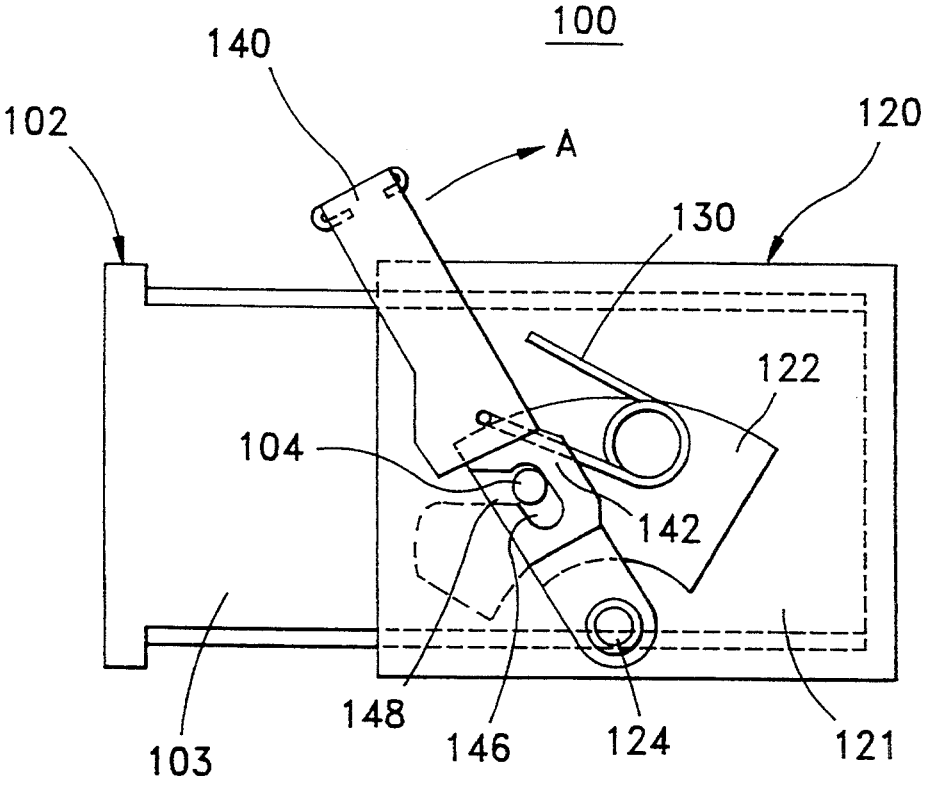
(PRIOR ART) Fig. 3
FIG. 3 is a side view of a conventional lever-type connector.

Next, we will explain operation of the lever 2 in joining the plug housing 40 and the cap housing 80 with reference to FIG. 2. FIGS. 2(A) and (B) are longitudinal cross sections of the lever-type connector shown in the FIG. 1. In the drawings, the lever-type connector is shown in the states before and after the plug housing 40 and the cap housing 80 are completely joined together. In the FIG. 2(A), the lever 2 is turned toward the back, and the plug housing 40 is also in its back position. One can easily see that the cover housing 10 is engaged with the lugs 86 of the cap housing 80 and the sealing element 42 is in elastic contact with the inner walls 94 of the cap housing 80. Contacts of the cap housing 80 are not shown in the drawing. When in this position, the lever 2 is pushed by a finger tip in the direction shown by the arrow, the plug housing 40 and the cap housing 80 assume the position shown in the cross section depicted in the FIG. 2(B).

As shown in the FIG. 2(A), the lever 2 is rotated clockwise in the direction of the arrow A using the mounting projections 18 as a fulcrum. The lever lugs 5 provide pressure against arc-shaped surface 48 of the lug engaging member 50, thus moving the plug housing 40 in the direction shown by the arrow B. When the plug housing 40 is in its extreme right position, the lever 2 assumes the position shown in the FIG. 2(B). In this position the back end 58 of the plug housing 40 enters the opening 12 of the cover housing 10. The total length of the lever-type connector becomes that of the cover housing 10 and the cap housing 80 joined together. The sealing element 42 is in elastic contact with the inner walls 94 of the cap housing 80, and at the same time it prevents further movement in the cap housing 80 as shown in the FIG. 2(B). It is also possible to make in the cap housing 80 a step 96 which will stop movement of the sealing element 42.

The lever-type connector comprising a cover housing, a plug sub-assembly having a plug housing which is located inside the cover housing by means of a lever, and a cap housing which is latched to the cover housing, and the plug housing is moved inside the cap housing by the lever, has the following effect.

After the plug sub-assembly is inserted in the cap housing, the plug housing and the cap housing are easily joined together by operating the lever. Therefore, a reliable connection can be made even in locations where it is impossible to see the connector directly.

In addition, since the double-lock device can be inserted perpendicular to the cavities of the plug housing, the contacts can be reliably secured in the cavities.

I claim

1. A lever operated connector, comprising:

a plug subassembly having a cover housing, a plug housing, and a lever, said cover housing having an opening for receiving said plug housing, said plug housing having cavities for receiving terminals therein, said lever being attachable to said cover housing and being adapted to move said plug housing relative to said cover housing; and a cap housing for receiving contacts therein and having an opening for receiving said plug housing of said subassembly and being attachable to said cover housing;

whereby operation of said lever moves said plug housing from an unterminated position to a terminated position.

2. The connector of claim 1, wherein said plug housing has a sealing element disposed therearound.

3. The connector of claim 2, wherein said sealing element fits tightly within said cap housing.

4. The connector of claim 1, wherein said cover housing has side walls, mounting projections, and openings along said side walls, said lever has holes to receive said mounting projections on said cover housing and lugs which are received in said openings in said side walls, and said plug housing having lug engaging members aligned with said openings on said side walls, said lug engaging members receive said lugs on said lever.

5. The connector of claim 4, wherein said lever has a flat operating section, and arms extending from the operating section, said holes being disposed on ends of said arms, and the lugs being disposed on said arms between said operating section and said holes.

6. The connector of claim 5, wherein said lug engaging members have arcuate shaped surfaces for receiving said lugs.

7. The connector of claim 6, wherein said lug engaging members are spaced apart on either side of said lugs.

* * * * *